US012042840B2

(12) United States Patent
Irie et al.

(10) Patent No.: US 12,042,840 B2
(45) Date of Patent: Jul. 23, 2024

(54) HOT PRESS PROCESSING METHOD AND PROCESSING DEVICE

(71) Applicant: MAZDA MOTOR CORPORATION, Hiroshima (JP)

(72) Inventors: Naoyuki Irie, Hiroshima (JP); Ichirou Ino, Hiroshima (JP); Yoshihide Hirao, Hiroshima (JP); Chie Okawa, Hiroshima (JP)

(73) Assignee: MAZDA MOTOR CORPORATION, Hiroshima (JP)

( * ) Notice: Subject to any disclaimer, the term of this patent is extended or adjusted under 35 U.S.C. 154(b) by 816 days.

(21) Appl. No.: 17/041,237

(22) PCT Filed: Feb. 14, 2019

(86) PCT No.: PCT/JP2019/005306

§ 371 (c)(1),
(2) Date: Sep. 24, 2020

(87) PCT Pub. No.: WO2019/187742

PCT Pub. Date: Oct. 3, 2019

(65) Prior Publication Data

US 2021/0008610 A1 Jan. 14, 2021

(30) Foreign Application Priority Data

Mar. 30, 2018 (JP) ..... 2018-066819

(51) Int. Cl.
*B21D 22/26* (2006.01)
*B21D 37/16* (2006.01)
(Continued)

(52) U.S. Cl.
CPC ..... *B21D 37/16* (2013.01); *B21D 22/26* (2013.01); *C21D 1/18* (2013.01); *C21D 9/0068* (2013.01)

(58) Field of Classification Search
CPC ..... B21D 22/208; C21D 1/18
See application file for complete search history.

(56) References Cited

U.S. PATENT DOCUMENTS

2015/0367396 A1 12/2015 Kong
2016/0250677 A1 9/2016 Kong
(Continued)

FOREIGN PATENT DOCUMENTS

CN 105195628 A 12/2015
DE 102015218454 A1 * 3/2017
(Continued)

OTHER PUBLICATIONS

Machine translation of DE-102015218454-A1 (Year: 2017).*
International Search Report issued in PCT/JP2019/005306; mailed Apr. 23, 2019.

*Primary Examiner* — Kyle A Cook
(74) *Attorney, Agent, or Firm* — Studebaker & Brackett PC

(57) ABSTRACT

A hot press processing device 1 includes steps of: a heating step of heating a workpiece W; a press step of press-molding the workpiece W heated in the heating step; a cooling step of cooling a part of the workpiece W press-molded in the press step and causing it to undergo martensite transformation to form a hard zone Zh in the workpiece W, and cooling another part of the workpiece W and causing it to undergo ferrite/bainite transformation to form a soft zone Zs in the workpiece W. In the cooling step, the hot press processing device 1 cools a predetermined portion Zb in the soft zone Zs after increasing rigidity and hardness of the predetermined portion Zb.

7 Claims, 7 Drawing Sheets

(51) Int. Cl.
*C21D 1/18* (2006.01)
*C21D 9/00* (2006.01)

(56) References Cited

U.S. PATENT DOCUMENTS

| | | | | |
|---|---|---|---|---|
| 2017/0341684 | A1* | 11/2017 | Goldyn | B21D 53/88 |
| 2018/0216204 | A1 | 8/2018 | Ghouati | |
| 2019/0054958 | A1* | 2/2019 | Marquez Duran | C21D 1/673 |
| 2019/0106155 | A1* | 4/2019 | Singh | C21D 1/673 |
| 2019/0119768 | A1* | 4/2019 | Schleichert | C21D 8/0205 |

FOREIGN PATENT DOCUMENTS

| | | | | |
|---|---|---|---|---|
| DE | 10 2017 201 674 | B3 | 3/2018 | |
| JP | 2016-002594 | A | 1/2016 | |
| WO | WO-2006038868 | A1 * | 4/2006 | B21D 22/02 |
| WO | 2017/172546 | A1 | 10/2017 | |

* cited by examiner

HOT PRESS PROCESSING METHOD AND PROCESSING DEVICE

TECHNICAL FIELD

The technique disclosed herein relates to a hot press processing method and a hot press processing device.

BACKGROUND ART

A hot press processing method is generally known in which a workpiece is heated to an austenite region and press-molded and then cooled within a die to obtain an ultra-high strength molded product through martensite transformation.

For example, Patent Literature 1 discloses an example of such a hot press processing method (hot stamping method) in which Ni, Cr, and Mo are added to a workpiece (blank) to mold it within an austenite region without causing ferrite/bainite transformation.

CITATION LIST

Patent Literature

Patent Literature 1: Japanese Patent Laid-Open No. 2016-002594

SUMMARY OF INVENTION

Technical Problem

As an application example of the method disclosed in Patent Literature 1, a molded product has recently been proposed that includes a combination of a hard zone obtained by martensite transformation and a soft zone obtained by ferrite/bainite transformation. This proposed molded product has both high strength by virtue of the hard zone and extensibility by virtue of the soft zone despite being a single molded product.

However, there is difference in volume between martensite, which forms the hard zone, and ferrite and bainite, which form the soft zone, due to difference in their crystal structures. For this reason, unintended deformation may occur in the soft zone due to heat shrink during cooling, such as warpage of the molded product. Suppression of such deformation is required to increase processing accuracy for the molded product.

The technique disclosed herein has been devised in view of the foregoing and aims to suppress unintended deformation during cooling when a workpiece is processed into a molded product including a hard zone and soft zone, and eventually increase processing accuracy for the molded product.

Solution to Problem

Through extensive studies, the present inventors have arrived at an idea of cooling a predetermined portion in a soft zone after employing deformation suppressing means in the predetermined portion, and have made the present disclosure.

Specifically, the technique disclosed herein is directed to a hot press processing method for processing a workpiece into a molded product. The hot press processing method includes: a heating step of heating the workpiece; a press step of press-molding the workpiece heated in the heating step; and a cooling step of cooling a part of the workpiece press-molded in the press step and causing the part to undergo martensite transformation to form a hard zone in the workpiece, and cooling another part of the workpiece and causing the other part to undergo ferrite/bainite transformation to form a soft zone in the workpiece. In the cooling step, a predetermined portion in the soft zone is cooled after at least one of rigidity and hardness of the predetermined portion is increased.

This method forms both a hard zone and a soft zone in a single molded product, ensuring both high strength by virtue of the hard zone and extensibility by virtue of the soft zone.

Additionally, in this method, in the cooling step, the predetermined portion in the soft zone is cooled after at least one of rigidity and hardness of the predetermined portion is increased. Increasing at least one of rigidity and hardness beforehand helps suppress warpage and the like due to heat shrink. Employing deformation suppressing means prior to cooling in this manner helps suppress unintended deformation in the soft zone and increase processing accuracy for the molded product.

In the hot press processing method, in the cooling step, the predetermined portion may be cooled after the predetermined portion is given a shape having a higher rigidity than another portion in the soft zone.

This method increases rigidity of the predetermined portion, which is advantageous for suppressing unintended deformation in the soft zone and increasing processing accuracy for the molded product.

In the hot press processing method, in the cooling step, the predetermined portion may be cooled after the predetermined portion is given a bead shape extending in a specific direction.

This method increases rigidity of the predetermined portion by giving a bead shape to the predetermined portion. This is advantageous for suppressing unintended deformation in the soft zone and increasing processing accuracy for the molded product.

In the hot press processing method, in the cooling step, the predetermined portion may be cooled after the predetermined portion is given the bead shape extending along a boundary between the hard zone and the soft zone.

In the hot press processing method, in the cooling step, the predetermined portion may be cooled after the predetermined portion is quenched.

This method increases hardness of the predetermined portion by quenching the predetermined portion. This is advantageous for suppressing unintended deformation in the soft zone and increasing processing accuracy for the molded product.

In the hot press processing method, in the cooling step, the predetermined portion may be cooled after the predetermined portion is given a shape having a higher rigidity than another portion in the soft zone and quenched.

This method increases both rigidity and hardness of the predetermined portion. This is advantageous for suppressing unintended deformation in the soft zone and increasing processing accuracy for the molded product.

The molded product may be a vehicle body component of an automobile.

The molded product may be a frame component of an automobile.

The molded product may be a pillar part of an automobile.

Another technique disclosed herein is directed to a hot press processing device for processing a workpiece into a molded product. The hot press processing device executes steps including: a heating step of heating the workpiece; a press step of press-molding the workpiece heated in the heating step; and a cooling step of cooling a part of the workpiece press-molded in the press step and causing the part to undergo martensite transformation to form a hard zone in the workpiece, and cooling another part of the workpiece and causing the other part to undergo ferrite/bainite transformation to form a soft zone in the workpiece. In the cooling step, a predetermined portion in the soft zone is cooled after at least one of rigidity and hardness of the predetermined portion is increased.

In this configuration, both a hard zone and a soft zone are formed in a single molded product, ensuring both high strength by virtue of the hard zone and extensibility by virtue of the soft zone.

Additionally, in this configuration, in the cooling step, the predetermined portion in the soft zone is cooled after at least one of rigidity and hardness of the predetermined portion is increased. Increasing at least one of rigidity and hardness beforehand helps suppress warpage and the like due to heat shrink. Employing deformation suppressing means prior to cooling in this manner helps suppress unintended deformation in the soft zone and increase processing accuracy for the molded product.

In the cooling step, the hot press processing device may cool the predetermined portion after giving the predetermined portion a shape having a higher rigidity than another portion in the soft zone.

In the cooling step, the hot press processing device may cool the predetermined portion after giving the predetermined portion a bead shape extending in a specific direction.

In the cooling step, the hot press processing device may cool the predetermined portion after giving the predetermined portion the bead shape extending along a boundary between the hard zone and the soft zone In the cooling step, the hot press processing device may cool the predetermined portion after quenching the predetermined portion.

In the cooling step, the hot press processing device may cool the predetermined portion after giving the predetermined portion a shape having a higher rigidity than another portion in the soft zone and quenching the predetermined portion.

Advantageous Effect of Invention

As described above, the technique disclosed herein helps suppress unintended deformation during cooling when a workpiece is processed into a molded product having a hard zone and a soft zone and increase processing accuracy for the molded product.

DESCRIPTION OF EMBODIMENT

An embodiment of the present invention will be described below with reference to the drawings. It should be noted that the following description is exemplary only.

Figure 1:
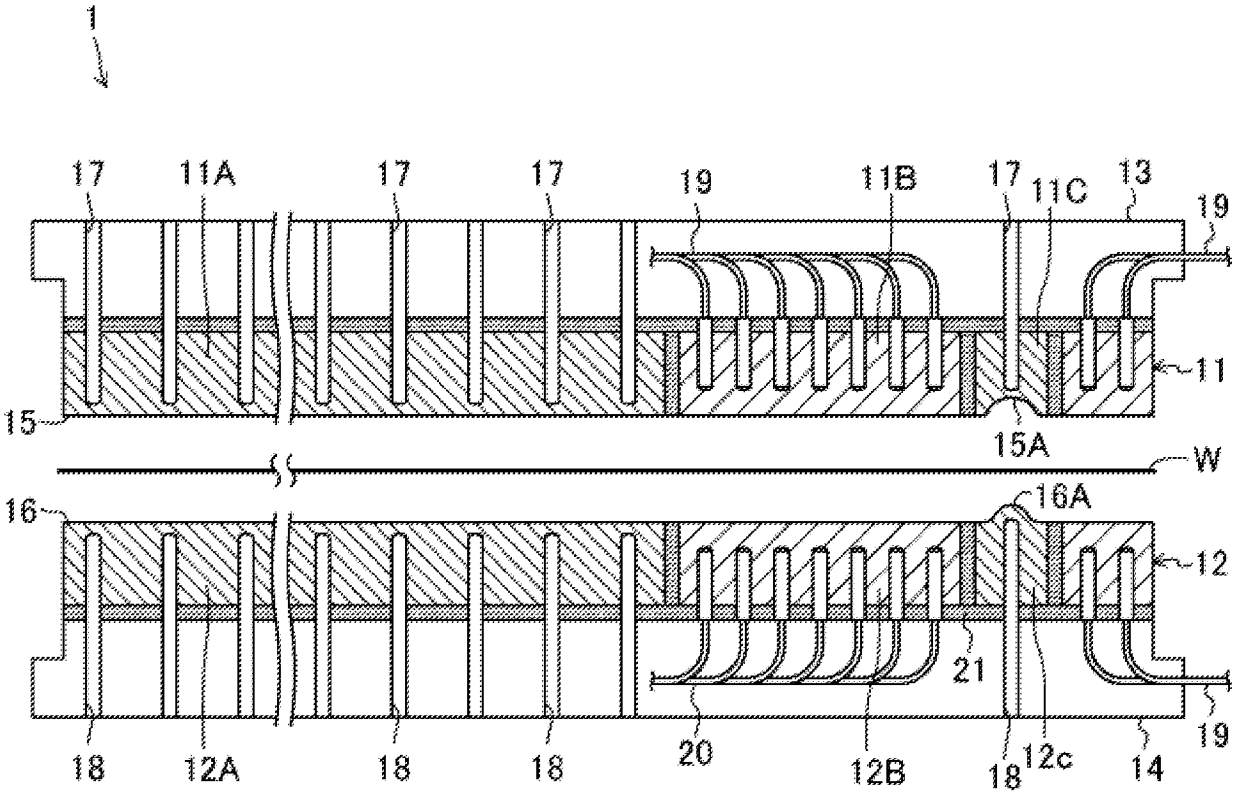
FIG. 1 is a sectional view showing a state in which a workpiece is loaded in a hot press processing device.
Figure 2:
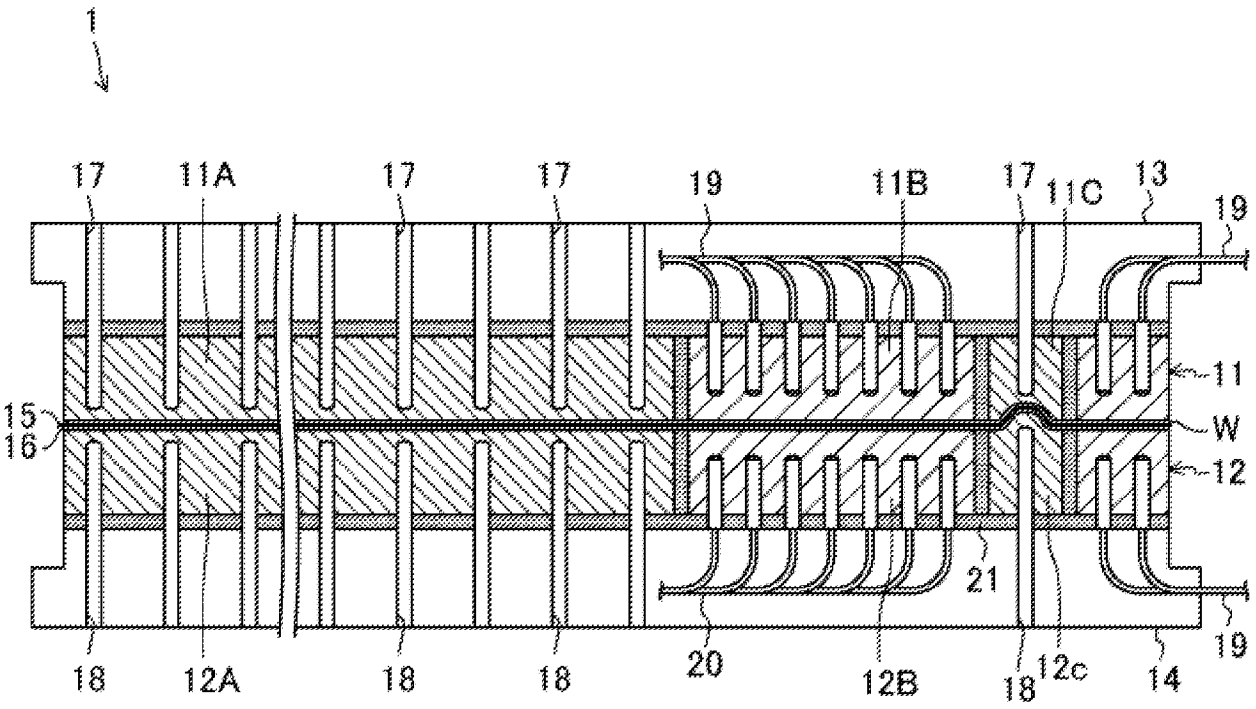
FIG. 2 is a sectional view showing a pressing state of the hot press processing device.
Figure 3:
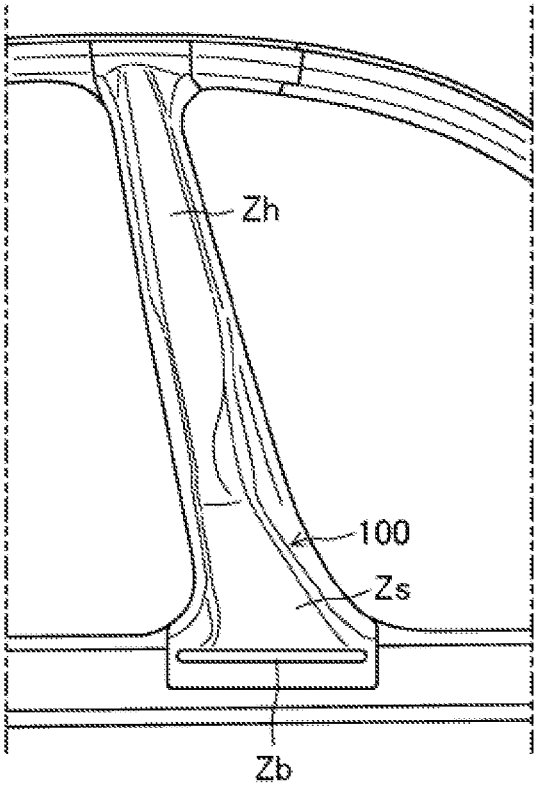
FIG. 3 shows an example of a pillar part as a press-molded product.

FIGS. 1 and 2 show a hot press processing device 1 according to the present embodiment. The hot press processing device 1 performs press molding on a heated workpiece W to process it into a press-molded product as shown in FIGS. 3 and 4.

The press-molded product according to the present embodiment is a pillar part 100 as a vehicle body component of an automobile. As shown in FIG. 3, this pillar part 100 forms a center pillar disposed between a floor panel and a roof panel of the automobile. That is, the pillar part 100 is formed in a narrow long plate shape and, in assembling a vehicle body, assembled with its longitudinal direction coinciding with a vehicle up-down direction. Hereinafter, a direction corresponding to a vehicle upward direction in assembling the vehicle body is simply referred to as an "upward direction", and a direction opposite thereto is referred to as a "downward direction". The terms like "up-down direction", "upper side" and "lower side" are used in similar meanings. Also, a direction corresponding to a vehicle front-rear direction in assembling the vehicle body is simply referred to as a "front-rear" direction.

Figure 4:
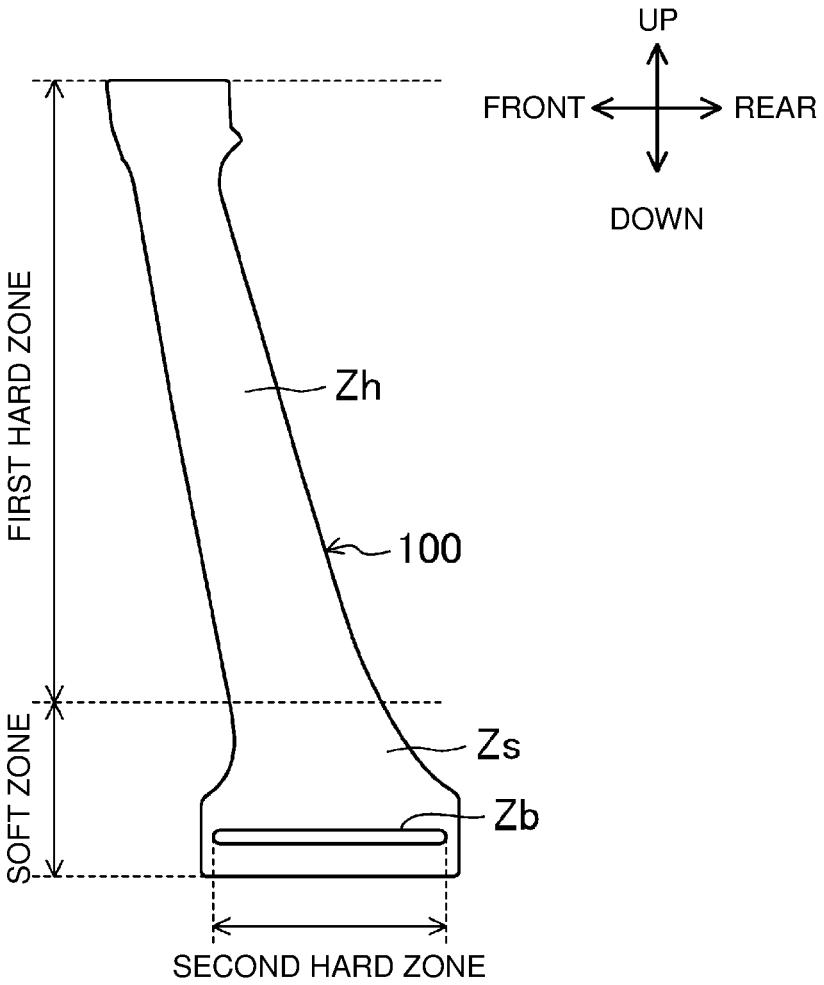
FIG. 4 shows an example of a pillar part made with deformation suppressing means.

As shown in FIG. 4, the pillar part 100 consists of a combination of a first hard zone Zh that is quench-hardened after press molding and a soft zone Zs that is obtained by air cooling after press molding. Specifically, a portion from an upper end to a center portion in the up-down direction forms the first hard zone Zh, and a lower end in the same direction forms the soft zone Zs.

A predetermined portion Zb in the soft zone Zs is given a bead shape extending in the front-rear direction (specific direction) and quenched similarly to the first hard zone Zh. As shown in FIG. 4, the bead shape extends substantially parallel to a boundary between the soft zone Zs and the first hard zone Zh. Hereinafter, this predetermined portion Zb is also referred to as a "second hard zone Zb".

Hot Press Processing Device

As shown in FIGS. 1 and 2, the hot press processing device 1 includes a die for obtaining the pillar part 100 as a press-molded product, namely an upper die 11 and a lower die 12 for press molding. The upper die 11 is fixed to an upper die holder 13. The upper die holder 13 is mounted with a slider (not shown) by which a press machine is raised and lowered. The lower die 12 is fixed to a lower die holder 14.

The upper die 11 includes a press molding surface 15 to press-mold a heated workpiece W. The lower die 12 includes a press molding surface 16 corresponding to the upper die 11. The upper die 11 and the lower die 12 are respectively sectioned into first die parts 11A, 12A for molding a portion corresponding to the first hard zone Zh, second die parts 11B, 12B for molding a portion corresponding to the soft zone Zs, and third die parts 11C, 12C for molding a portion corresponding to the second hard zone Zb, in this order from the left to the right in FIGS. 1 and 2.

The first die parts 11A, 12A and the third die parts 11C, 12C are provided with refrigerant passages 17, 18 through which liquid refrigerant (e.g., cooling water) is supplied for die cooling with the workpiece W pressed.

While in the present embodiment, only the first die parts 11A, 12A and the third die parts 11C, 12C are cooled by the liquid refrigerant, a direct water cooling configuration may be used instead of this configuration. In that case, the refrigerant passages 17, 18 penetrate the first die parts 11A, 12A and the third die parts 11C, 12C to open through the press molding surfaces 15, 16.

The second die parts 11B, 12B are provided with heaters 19, 20 for keeping heat in the pressed workpiece W. Each of the upper and lower heaters 19, 20 is configured as an electric heater and connected to a heater power source (not shown).

A boundary between the first die parts 11A, 12A and the second die parts 11B, 12B and a boundary between the second die parts 11B, 12B and the third die parts 11C, 12C are each divided by a heat insulator 21.

A portion of the press molding surface 16 of the lower die 12 corresponding to the third die parts 11C, 12C forms a protruding surface 16*a* protruding upward. Meanwhile, a portion of the press molding surface 15 of the upper die 11 corresponding to the third die parts 11C, 12C forms a recessed surface 15*a* that is a female part for the protruding surface 16*a* as a male part.

As shown in FIG. 1, the workpiece W is a flat plate-shaped blank. The workpiece W is preheated to a predetermined temperature (austenite temperature region) before being loaded between the upper die 11 and the lower die 12. Of portions of the workpiece W loaded between the upper die 11 and the lower die 12, a portion between the first die parts 11A, 12B and a portion between the third die parts 11C, 12C are formed by hot stamping, in which the portions are cooled in a pressed state after being press-molded. Meanwhile, of portions of the workpiece W, a portion between the second die parts 11B, 12B is kept hot by the heaters 19, 20 after being press-molded, as a preparation for causing its ferrite/bainite transformation.

In particular, the above-described bead shape is formed at the portion between the third die parts 11C, 12C due to the workpiece W being plastically deformed by the protruding surface 16*a* and the recessed surface 15*a* as the upper die 11 moves down toward the lower die 12.

The press-molded workpiece W is unloaded from the upper die 11 and the lower die 12 and then air-cooled.

Below a detailed description will be given of a hot press processing method using the hot press processing device 1.

Hot Press Processing Method

Figure 5:
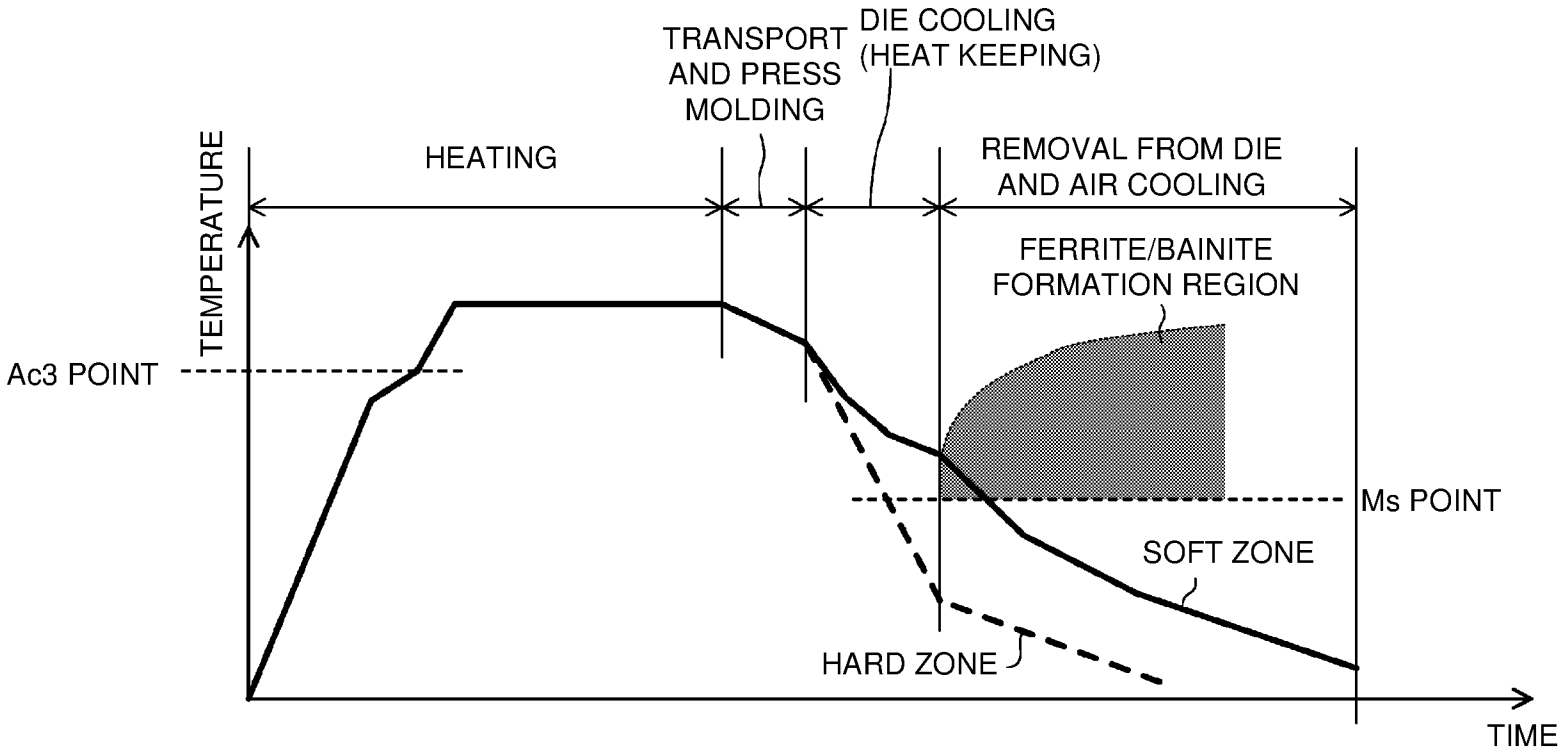
FIG. 5 shows an example of a transformation curve of the workpiece.

FIG. 5 shows an example of a transformation curve of the workpiece W.

1. Heating Step

First, the flat plate-shaped workpiece W is heated to or above an Ac3 point (a transformation temperature at which transformation from ferrite to austenite completes). The workpiece W thus completes its transformation to austenite.

2. Loading Step

As shown in FIG. 1, the heated workpiece W is loaded between the upper die 11 and the lower die 12.

3. Pressing Step

As shown in FIG. 2, the upper die 11 is moved down to press-mold the workpiece W into a shape according to the press molding surface 15 of the upper die 11 and the press molding surface 16 of the lower die 12. At this time, the portion of the pillar part 100 from its upper end to its central portion is formed by the first die parts 11A, 12A of the upper die 11 and the lower die 12, respectively, and the lower end of the pillar part 100 is formed by the second die parts 11B, 12B of the upper die 11 and the lower die 12, respectively.

Simultaneously, a pillar shape is given to the lower end of the pillar part 100 by the third die parts 11C, 12C of the upper die 11 and the lower die 12, respectively. The pillar shape is extended in the front-rear direction (direction perpendicular to the plane of the paper in FIG. 1). The portion given the pillar shape (the second hard zone Zb) forms a protrusion protruding in a plate thickness direction of the pillar part 100, as shown by a section A1-A1 in FIG. 7(*a*).

4. Cooling Step (Die Cooling)

With the workpiece W pressed by the upper die 11 and the lower die 12, liquid refrigerant is passed through the refrigerant passages 17, 18 of the first die parts 11A, 12A and the third die parts 11C, 12C. When water is used as the liquid refrigerant, the time during which the liquid refrigerant is passed is set to about two to three seconds. Simultaneously, the heaters 19, 20 of the second die parts 11B, 12B are heated. By heat from the heaters 19, 20, temperature of the second die parts 11B, 12B is kept at about 500° C., for example. As shown in FIG. 5, the temperature of the heaters 19, 20 may be set above a lower limit temperature in a ferrite/bainite formation region.

As a result, the portion between the first die parts 11A, 12A and the portion between the third die parts 11C, 12C of the workpiece W loaded in the die (a part of the workpiece) are cooled within the die below an Ms point (a transformation temperature at which transformation from austenite to martensite starts) and undergo martensite transformation in a quenched state (see a dashed line in FIG. 5). Thus, the portions cooled within the die have their hardness increased, resulting in forming the first and second hard zones Zh, Zb in the workpiece W.

Meanwhile, the portion of the workpiece W between the second die parts 11B, 12B is cooled so as to keep the temperature at or above the Ms point so that the portion does not undergo martensite transformation.

5. Removal Step

The upper die 11 is moved up to remove the press-molded workpiece W from the die, though not illustrated in the figures. The workpiece W removed from the die is unloaded from the lower die 12.

6. Cooling Step (Air Cooling)

The workpiece W unloaded from the lower die 12 is air-cooled in the atmosphere. As a result, the portions formed with the first and second hard zones Zh, Zb are cooled, more slowly than when within the die, to an ordinary temperature.

Meanwhile, another portion of the workpiece W, namely the portion having been kept hot by the heaters 19, 20 (another part of the workpiece) is cooled so as to pass through the ferrite/bainite formation region (see the hatched area in FIG. 5), as shown by the solid line in FIG. 5. Here, the ferrite/bainite formation region collectively refers to so-called a ferrite region and a bainite region. Hence, the portion having been kept hot undergoes ferrite/bainite transformation, resulting in forming the soft zone Zs composed of soft structures in the workpiece W. The portion formed with the soft zone Zs is then cooled further to an ordinary temperature.

Heat Shrink During Air Cooling

Thus, the press-molded pillar part 100 is obtained. Despite being a single molded product, the pillar part 100 has both high strength by virtue of the first hard zone Zh and extensibility by virtue of the soft zone Zs. In particular, this soft zone Zs allows the pillar part 100 to absorb collision energy in the event of a vehicle collision (in particular, a side collision).

However, there is difference in volume between martensite forming the first hard zone Zh and ferrite and bainite forming the soft zone Zs due to difference in crystal structures. For this reason, unintended deformation may occur in the soft zone Zs, such as warpage of the pillar part 100, due to heat shrink during air cooling.

Figure 6:
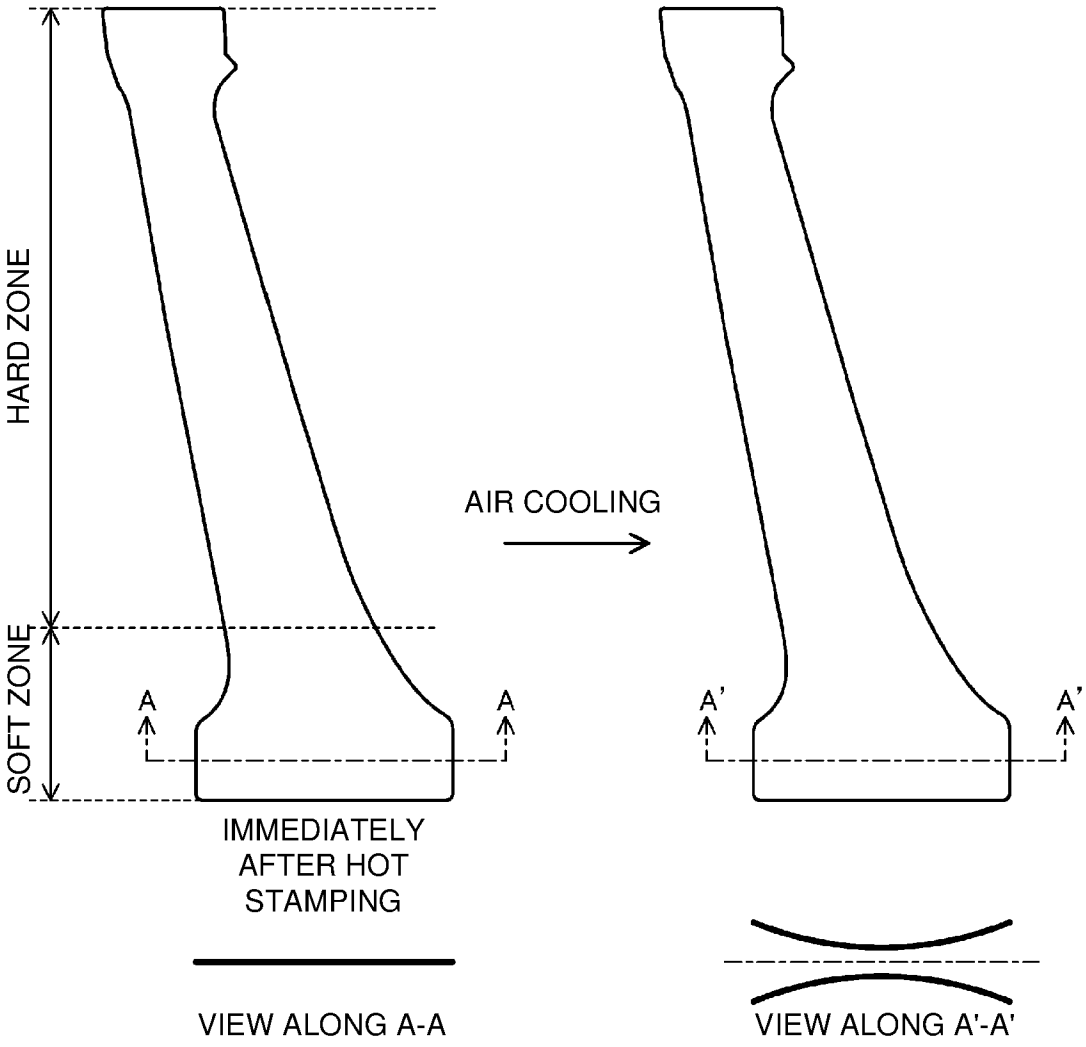
FIG. 6 shows an example of a pillar part made without deformation suppressing means.

As one form of such deformation, there is fear that the pillar part 100 may warp along the boundary between the hard zone and the soft zone, as shown by a section A-A section and a section A'-A' in FIG. 6. Suppression of such deformation is required to increase processing accuracy for the pillar part 100.

Hence, prior to air cooling, rigidity and hardness of the predetermined portion Zb in the soft zone Zs are increased as deformation suppressing means. Specifically, the predetermined portion Zb is given a bead shape extending in the front-rear direction, and this gives the predetermined portion Zb a higher rigidity than the rest of the soft zone Zs. In addition, the predetermined portion Zb is quenched before being air-cooled, and this gives the predetermined portion Zb a higher hardness than the rest of the soft zone Zs. Employing the deformation suppressing means prior to air cooling in this manner helps suppress warpage and the like due to heat shrink during air cooling and helps increase processing accuracy for the pillar part 100.

In particular, the second hard zone Zb given the bead shape is extended along the boundary between the first hard zone Zh and the soft zone Zs, and this helps effectively suppress warpage due to heat shrink.

Here, the pillar part 100 as a center pillar substantially has a breakage line (so-called bending breakage line) substantially along the front-rear direction in the event of a vehicle side collision. The pillar part 100 bends along the breakage line to absorb collision energy, and the bead shape forming the second hard zone Zb is extended along this breakage line. Hence, the bead shape does not inhibit absorption of collision energy as compared to a configuration in which the bead shape is extended in the up-down direction.

Modification of the Pillar Part

Figure 7:
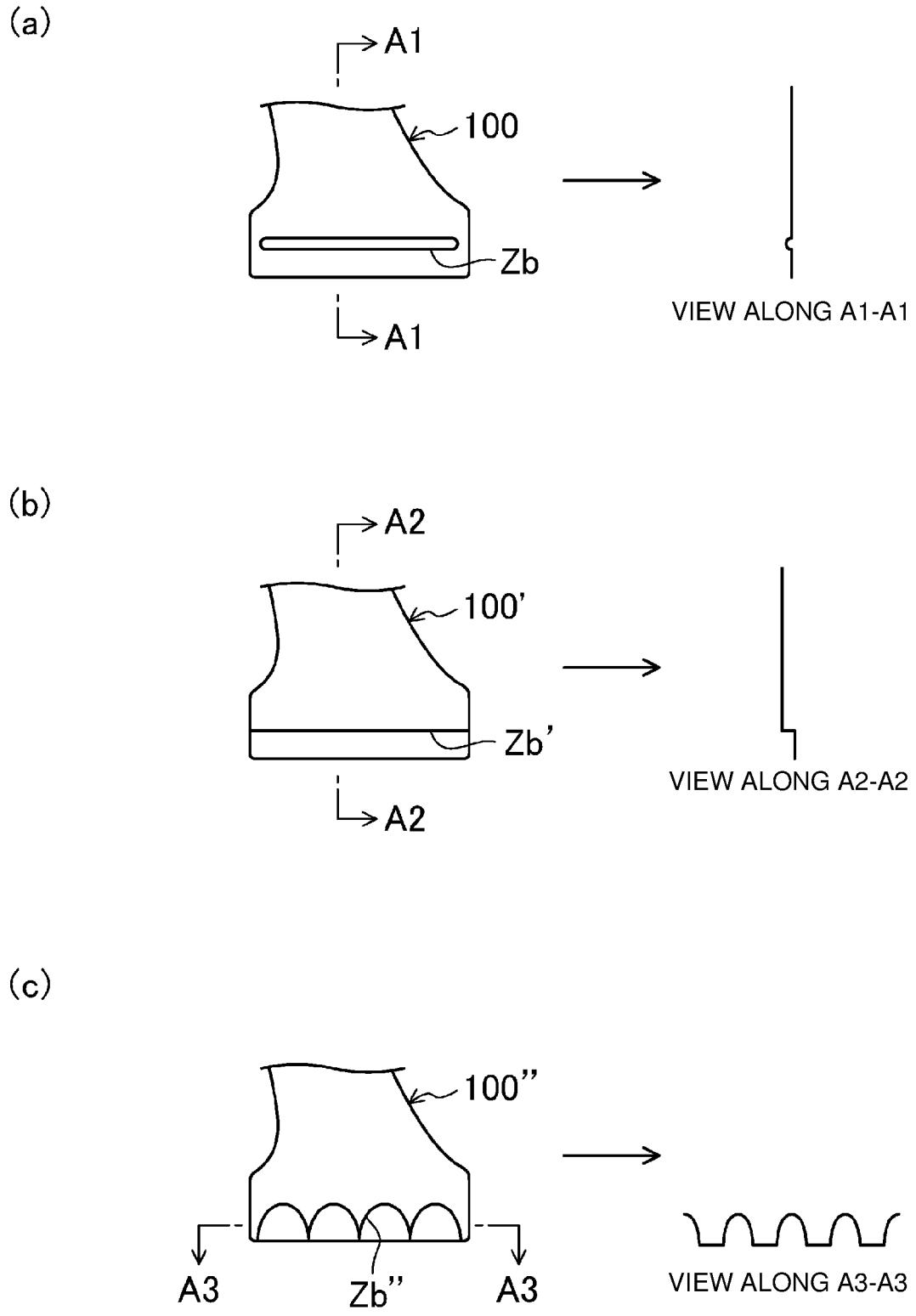
FIG. 7 shows examples of bead shapes.

In the above embodiment, the bead shape given to the second hard zone Zb forms a protrusion protruding in the plate thickness direction of the pillar part 100. However, the bead shape according to the present disclosure is not limited to this. For example, a bead shape formed by bending stepwise may be given to a second hard zone Zb of a pillar part 100' as shown in FIG. 7(*b*) and by a section A2-A2 therein.

In the first place, the shape given to the second hard zone Zb is not limited to the bead shape. For example, as shown in FIG. 7(*c*) and by a section A3-A3 therein, a concave-convex shape Zb' of a seating surface shape may be given to a lower end of a pillar part 100". The use of this shape helps increase rigidity of the soft zone too.

Other Embodiments

While in the above embodiment, the pillar part as a vehicle body component of an automobile has been described as an example of the molded product, the technique disclosed herein may also be applied to frame components of an automobile, for example. When applied to frame components such as side frames, the technique provides both high strength by virtue of the hard zone and processability by virtue of the soft zone despite a single molded product. In this case too, unintended deformation during cooling can be suppressed, helping increase processing accuracy for the molded product.

While in the above embodiment, the second hard zone Zb is both given the bead shape and quenched, the technique disclosed herein is not limited to this configuration. The second hard zone Zb may be either given the bead shape or quenched.

While in the above embodiment, air cooling in the atmosphere is performed to form the soft zone Zs, instead of this configuration, slow cooling within the die may be performed.

While in the above embodiment, the heaters 19, 20 are provided to keep heat in the portion formed with the soft zone Zs, instead of this configuration, a high-temperature fluid (e.g., oil) may flow through the second die parts 11B, 12B.

While in the above embodiment, the refrigerant passages 17, 18 and the heaters 19, 20 are disposed above and below the workpiece W as shown in FIG. 1, instead of this configuration, the refrigerant passages 17, 18 and the heaters 19, 20 may be disposed in front of, in back of, to the left of, and to the right of the workpiece W.

Instead of the configuration in which the heat insulator 21 is provided at the boundary between the first die parts 11A, 12A and the second die parts 11B, 12B and at the boundary between the second die parts 11B, 12B and the third die parts 11C, 12C, an air layer may be provided at each boundary.

In the method of the above embodiment, the soft zone Zs is formed by air cooling of the workpiece W after the first hard zone Zh is formed by cooling of the workpiece W within the die; alternatively, for example, the first hard zone Zh and the soft zone Zs may be concurrently formed by simultaneously performing die cooling using liquid refrigerant and slow cooling within the die after the bead shape is given to the predetermined portion Zb.

REFERENCE SIGNS LIST

1 Hot press processing device
100 Pillar part
W Workpiece
Zh First hard zone
Zs Soft zone
Zb Second hard zone (predetermined portion)

The invention claimed is:

1. A hot press processing method for processing a workpiece into a molded product, the hot press processing method comprising:

a heating step of heating the workpiece;

a press step of press-molding the workpiece heated in the heating step; and a cooling step of cooling a part of the workpiece press-molded in the press step and causing the part to undergo martensite transformation to form a hard zone in the workpiece, and cooling another part of the workpiece and causing the other part to undergo ferrite/bainite transformation to form a soft zone in the workpiece, wherein in the cooling step, a predetermined portion in a region where the soft zone is to be formed undergoes the martensite transformation instead of the ferrite/bainite transformation, such that at least one of rigidity and hardness of the predetermined portion is increased, and thereafter the other part of the workpiece including the predetermined portion is cooled, in the cooling step, the soft zone is formed by cooling the other part of the workpiece including the predetermined portion after quenching the predetermined portion to increase the at least one of rigidity and hardness, in the cooling step, the predetermined portion is cooled after the predetermined portion is given a shape having a higher rigidity than another portion in the soft zone, in the cooling step, the predetermined portion is cooled after the predetermined portion is given a bead shape extending in a specific direction, the predetermined portion defines a second hard zone separated from the hard zone and surrounded by the soft zone, the workpiece has a plate shape, and the bead shape forms a protrusion protruding in a plate thickness direction of the workpiece.

2. The hot press processing method according to claim 1, wherein in the cooling step, the predetermined portion is cooled after the predetermined portion is given the bead shape extending parallel to a boundary between the hard zone and the soft zone.

3. The hot press processing method according to claim 1, wherein in the cooling step, the predetermined portion is cooled after the predetermined portion is given the shape having the higher rigidity than the another portion in the soft zone and quenched.

4. The hot press processing device according to claim 1, wherein the second hard zone extends parallel to a boundary between the hard zone and the soft zone.

5. The hot press processing method according to claim 1, wherein the molded product is a vehicle body component of an automobile.

6. The hot press processing method according to claim 5, wherein the molded product is a frame component of the automobile.

7. The hot press processing method according to claim 5, wherein the molded product is a pillar part of the automobile.

* * * * *